US010337801B2

(12) United States Patent
Meshenky et al.

(10) Patent No.: US 10,337,801 B2
(45) Date of Patent: Jul. 2, 2019

(54) HEAT EXCHANGER FOR COOLING A FLOW OF CHARGE AIR, AND METHOD OF ASSEMBLING THE SAME

(71) Applicant: Modine Manufacturing Company, Racine, WI (US)

(72) Inventors: Steven Meshenky, Mt. Pleasant, WI (US); Christopher Michael Moore, Racine, WI (US); Robert Cook, Racine, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 59 days.

(21) Appl. No.: 15/105,628

(22) PCT Filed: Dec. 18, 2014

(86) PCT No.: PCT/US2014/071162

§ 371 (c)(1),
(2) Date: Jun. 17, 2016

(87) PCT Pub. No.: WO2015/095523

PCT Pub. Date: Jun. 25, 2015

(65) Prior Publication Data

US 2016/0320140 A1 Nov. 3, 2016

Related U.S. Application Data

(60) Provisional application No. 61/919,419, filed on Dec. 20, 2013.

(51) Int. Cl.
*F28D 9/00* (2006.01)
*F28F 9/007* (2006.01)
(Continued)

(52) U.S. Cl.
CPC ..... *F28D 9/0043* (2013.01); *F28D 9/0037* (2013.01); *F28F 9/0075* (2013.01);
(Continued)

(58) Field of Classification Search
CPC .... F28D 9/0043; F28D 9/0037; F28F 9/0075; F28F 9/0226; F28F 9/08; F28F 9/12;
(Continued)

(56) References Cited

U.S. PATENT DOCUMENTS 4,331,201 A * 5/1982 Hesse ..... B23P 11/00 165/149
4,474,162 A 10/1984 Mason
(Continued)

FOREIGN PATENT DOCUMENTS

DE 102012006346 A1 10/2013

OTHER PUBLICATIONS

International Search Report and Written Opinion for Application No. PCT/US2014/071162 dated Dec. 18, 2014 (21 pages).

*Primary Examiner* — Jon T. Schermerhorn, Jr.
(74) *Attorney, Agent, or Firm* — Michael Best & Friedrich LLP; Jeroen Valensa; Michael Bergnach

(57) ABSTRACT

A heat exchanger for cooling a flow of charge air includes a heat exchanger core that is inserted through an aperture of a housing. A leak-free seal is maintained along the periphery of the aperture by the compression of a gasket between a top plate of the heat exchanger core and a planar bearing surface of the housing. Compression of the gasket is maintained by one or more deformable retaining members that are disposed against the top plate.

15 Claims, 8 Drawing Sheets

(51) Int. Cl.
*F28F 9/12* (2006.01)
*F28F 9/08* (2006.01)
*F28D 21/00* (2006.01)

(52) U.S. Cl.
CPC ..... *F28F 9/08* (2013.01); *F28F 9/12* (2013.01); *F28D 2021/0082* (2013.01); *F28F 2230/00* (2013.01); *F28F 2265/16* (2013.01); *F28F 2275/04* (2013.01); *F28F 2275/08* (2013.01); *F28F 2275/12* (2013.01); *F28F 2275/16* (2013.01)

(58) Field of Classification Search
CPC ..... F28F 9/14; F28F 2275/08; F28F 2230/00; F28F 2265/16; F28F 2275/12; F28F 2275/16; Y10S 165/473; Y10S 165/426; H01L 2023/4087; H05K 7/1408; H05K 7/1404; Y10T 24/45241
See application file for complete search history.

(56) References Cited

U.S. PATENT DOCUMENTS

| | | | | |
|---|---|---|---|---|
| 4,899,815 | A * | 2/1990 | Bosch | F28F 9/0226 165/173 |
| 5,311,933 | A * | 5/1994 | Lee | F28F 9/0226 165/149 |
| 6,892,796 | B1 | 5/2005 | Nagashima et al. | |
| 8,316,925 | B2 | 11/2012 | Pimentel et al. | |
| 2007/0175617 | A1* | 8/2007 | Brost | F02B 29/0462 165/149 |
| 2009/0014153 | A1* | 1/2009 | Pimentel | F02B 29/0462 165/67 |
| 2011/0017425 | A1 | 1/2011 | Bourgoin et al. | |
| 2012/0018127 | A1 | 1/2012 | Iwasaki | |
| 2012/0061053 | A1 | 3/2012 | Geskes et al. | |
| 2014/0224229 | A1 | 8/2014 | Brand et al. | |

* cited by examiner

FIG. 5A
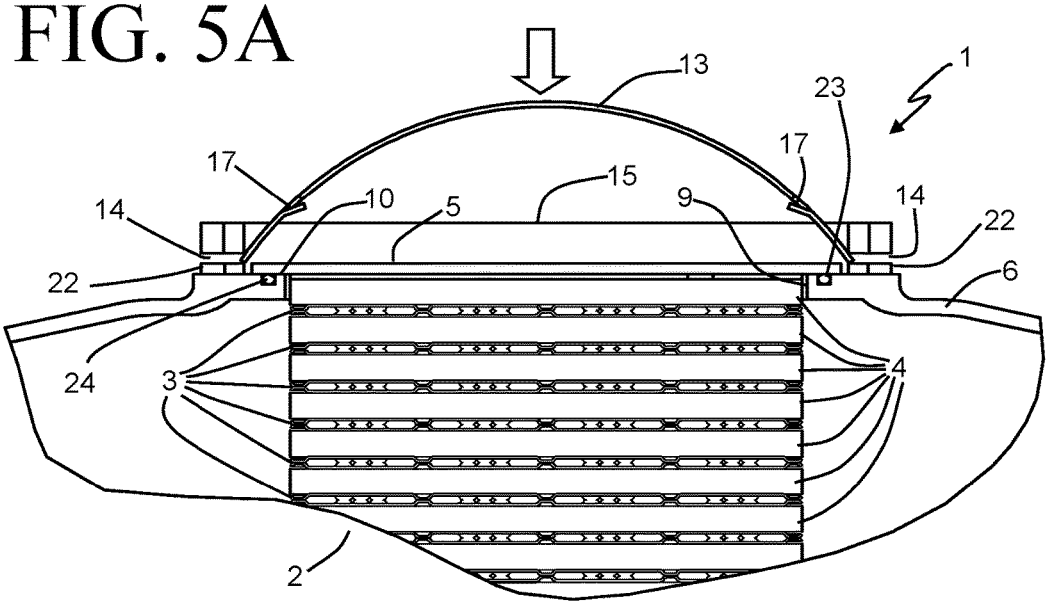
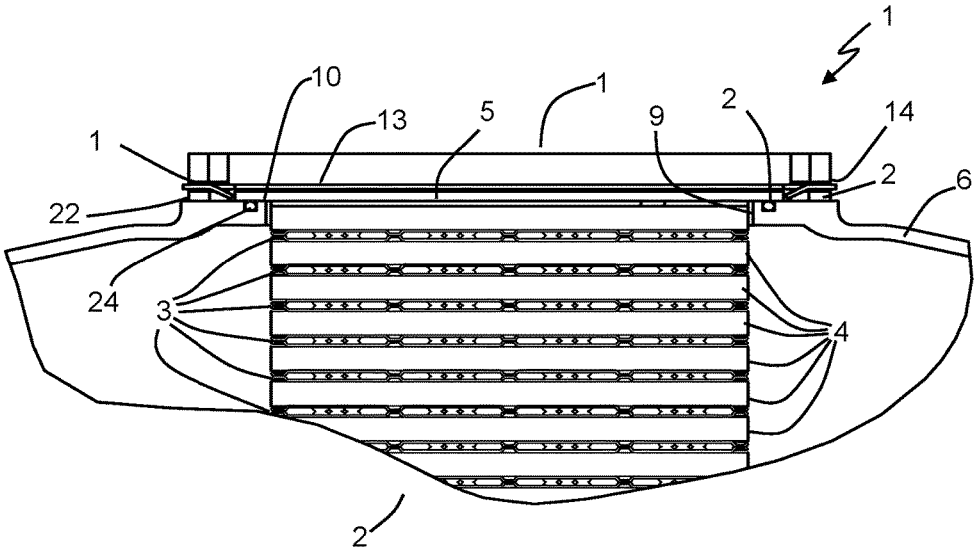
FIG. 5B

FIG. 7
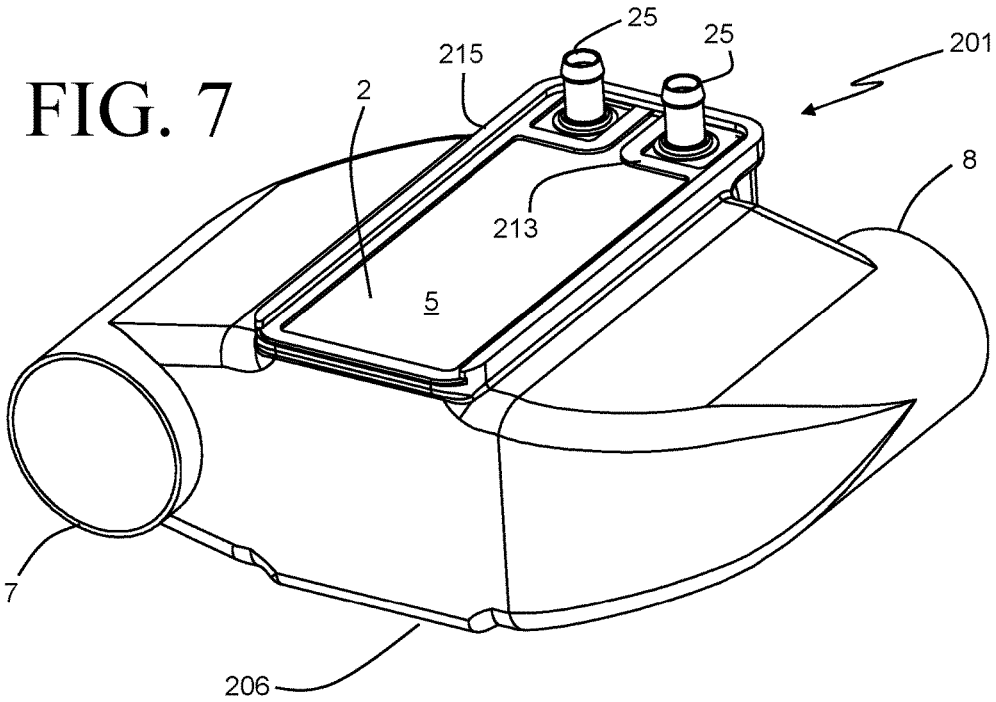
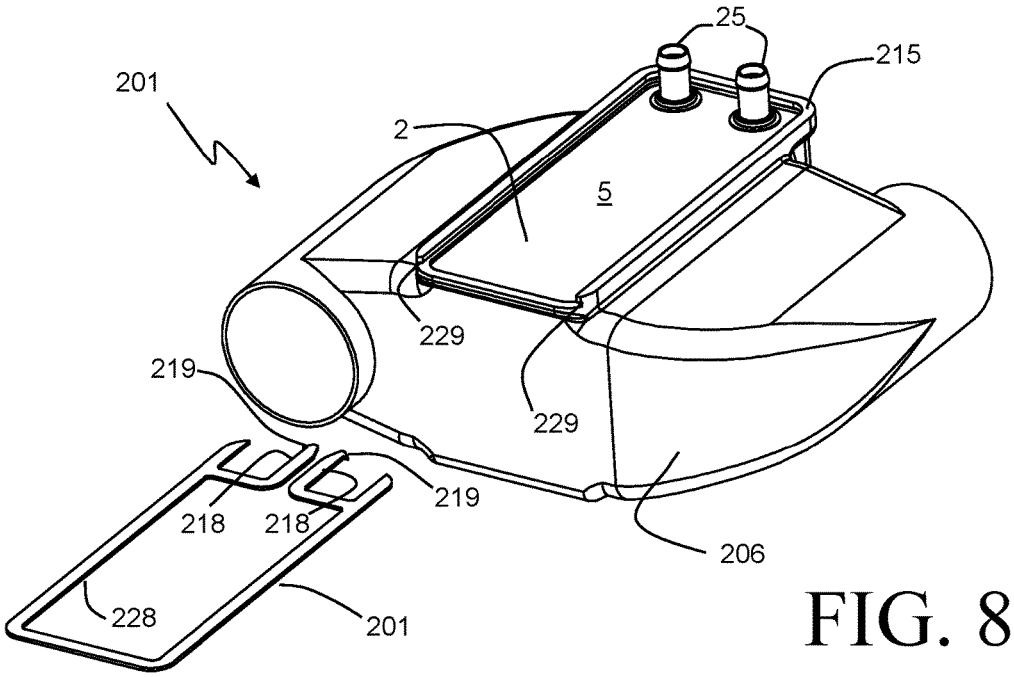
FIG. 8

FIG. 9
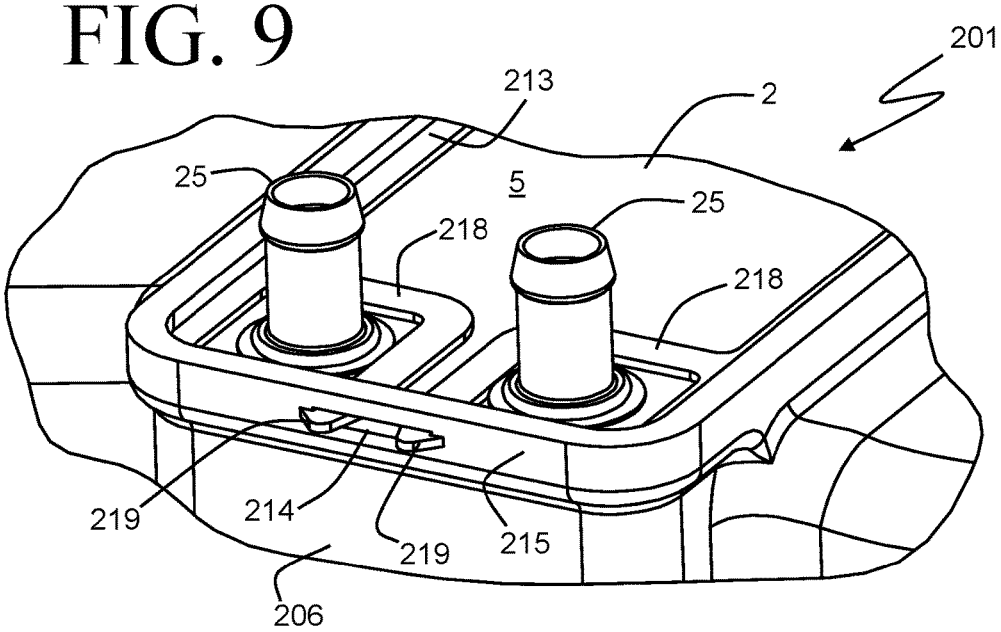
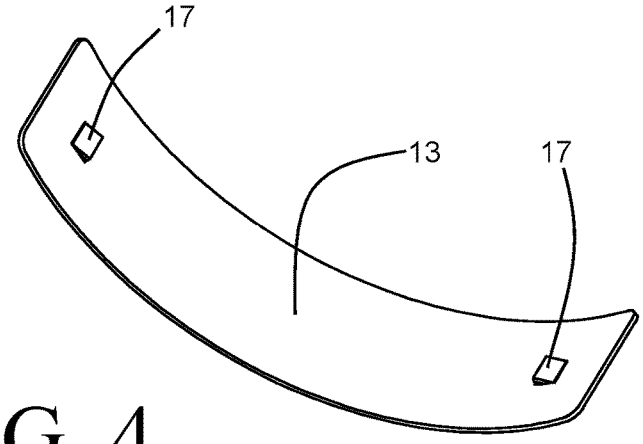
FIG. 4

HEAT EXCHANGER FOR COOLING A FLOW OF CHARGE AIR, AND METHOD OF ASSEMBLING THE SAME

CROSS REFERENCE TO RELATED APPLICATIONS

This application claims priority to U.S. Provisional Patent Application No. 61/919,419, filed Dec. 20, 2013, the entire contents of which are hereby incorporated by reference.

BACKGROUND

Charge air coolers are used in conjunction with turbocharged internal combustion engine systems. In such systems, residual energy from the combustion exhaust is recaptured through an exhaust expansion turbine, and the recaptured energy is used to compress or "boost" the pressure of the incoming air (referred to as the "charge air") being supplied to the engine. This raises the operating pressure of the engine, thereby increasing the thermal efficiency and providing greater fuel economy.

The compression of the charge air using the exhaust gases typically leads to a substantial increase in temperature of the air. Such a temperature increase can be undesirable for at least two reasons. First, the density of the air is inversely related to its temperature, so that the amount of air mass entering the combustion cylinders in each combustion cycle is lower when the air temperature is elevated, leading to reduced engine output. Second, the production of undesirable and/or harmful emissions, such as oxides of nitrogen, increases as the combustion temperature increases. The emissions levels for internal combustion engines is heavily regulated, often making it necessary to control the temperature of the air entering the combustion chambers to a temperature that is relatively close to the ambient air temperature. As a result, cooling of the charge air using charge air coolers has become commonplace for turbocharged engines.

In some applications, the charge air is cooled using a liquid coolant (for example, engine coolant). Some known types of these liquid cooled charge air coolers include a metallic core with sealed liquid passages arranged in heat transfer relation to air passages, and a housing surrounding the core to direct the flow of charge air through the air passages.

SUMMARY

According to one embodiment of the invention, a heat exchanger for cooling a flow of charge air includes a heat exchanger core with alternating coolant plates and air fins arranged in a core stacking direction, and a top plate at one end of the core in the core stacking direction. A housing of the heat exchanger has an air inlet, an air outlet, and an aperture through which the coolant plates and air fins are received into the housing. The aperture is bounded by a generally planar bearing surface, and a gasket is compressed between a face of the top plate and the housing to provide an air seal at the aperture. A retaining member is disposed against a face of the top plate to compress the gasket.

In some embodiments, the retaining member engages recesses along the periphery of the bearing surface in order to maintain the force for compressing the gasket. In some such embodiments, the retaining member is one of several retaining members. In some embodiments the recesses are provided in a wall of the housing that is disposed along a periphery of the generally planar bearing surface.

In some embodiments, the retaining member includes a deformable metal component. In some embodiments the retaining member is plastically deformed in order to be disposed against the top plate. In other embodiments the retaining member is elastically deformed to secure the retaining member to the housing.

In some embodiments the retaining member is of a generally planar shape, and in some such embodiments it is elastically deformed from an arcuate shape to the generally planar shape during the installation process.

According to another embodiment of the invention, a method for assembling a heat exchanger includes inserting a heat exchanger core through an aperture of a housing into a cavity of the housing. A gasket is compressed between a top plate of the heat exchanger core and the housing along the periphery of the aperture. At least one retaining member is elastically deformed and is secure to the housing in order to maintain the compression of the gasket.

In some embodiments the retaining members are secured by engaging recesses along the periphery of a generally planar bearing surface that surrounds the aperture.

BRIEF DESCRIPTION OF THE DRAWINGS

FIG. 4 is a perspective view of a retaining clip of the embodiment of FIG. 1.

FIGS. 5A-B are partial sectional views along the lines V-V of FIG. 1, showing the heat exchanger of FIG. 1 in various stages of assembly.

FIG. 7 is a perspective view of a heat exchanger according to another embodiment of the invention.

FIG. 8 is a partial exploded perspective view of the heat exchanger of FIG. 7.

FIG. 9 is a partial perspective view of a portion of the heat exchanger of FIG. 7.

DETAILED DESCRIPTION

Before any embodiments of the invention are explained detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
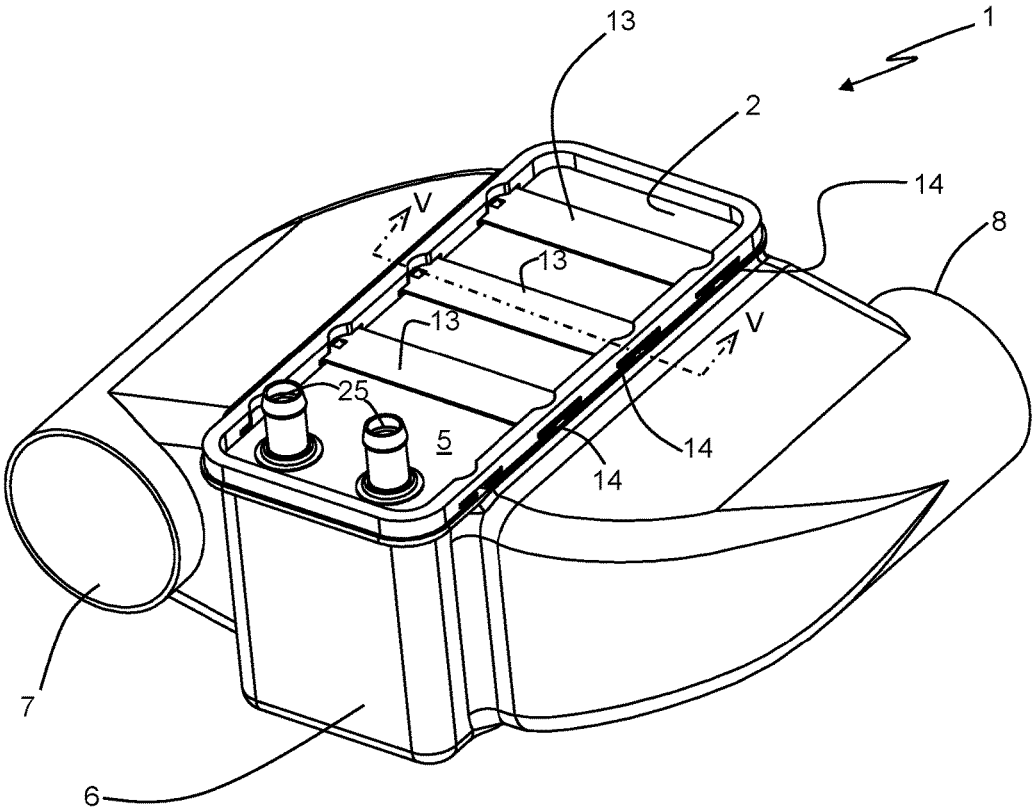
FIG. 1 is a perspective view of a heat exchanger according to an embodiment of the invention.
Figure 2:
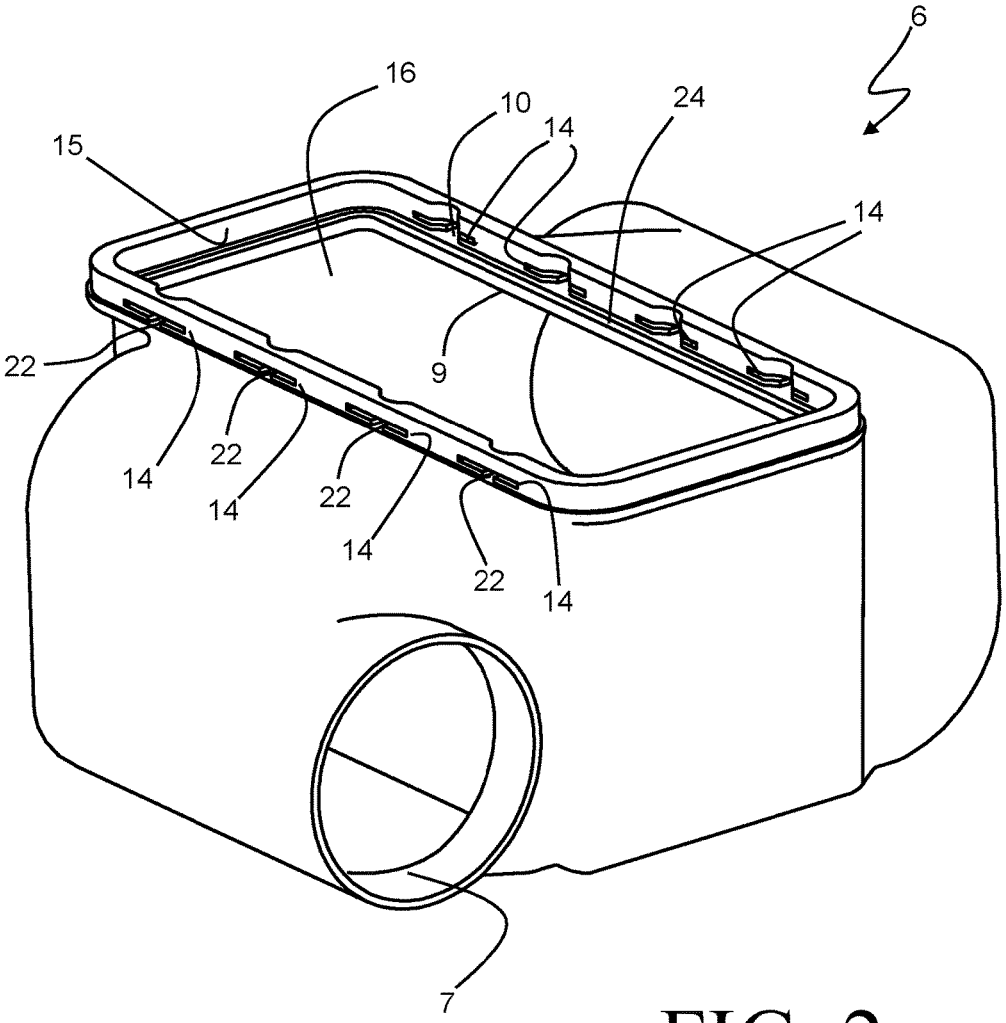
FIG. 2 is a perspective view of a housing of the eat exchanger of FIG. 1.

A heat exchanger 1 for cooling a flow of charge air according to an embodiment of the invention is depicted in FIG. 1. The heat exchanger 1 is especially well suited for use as a charge air cooler for turbo-charged combustion engine powered passenger cars, but it should be understood that its use is not limited to such an application. The heat exchanger 1 might also be applicable to the cooling of charge air for other types of processes, as well as to the cooling or heating of other fluids.

Figure 3:
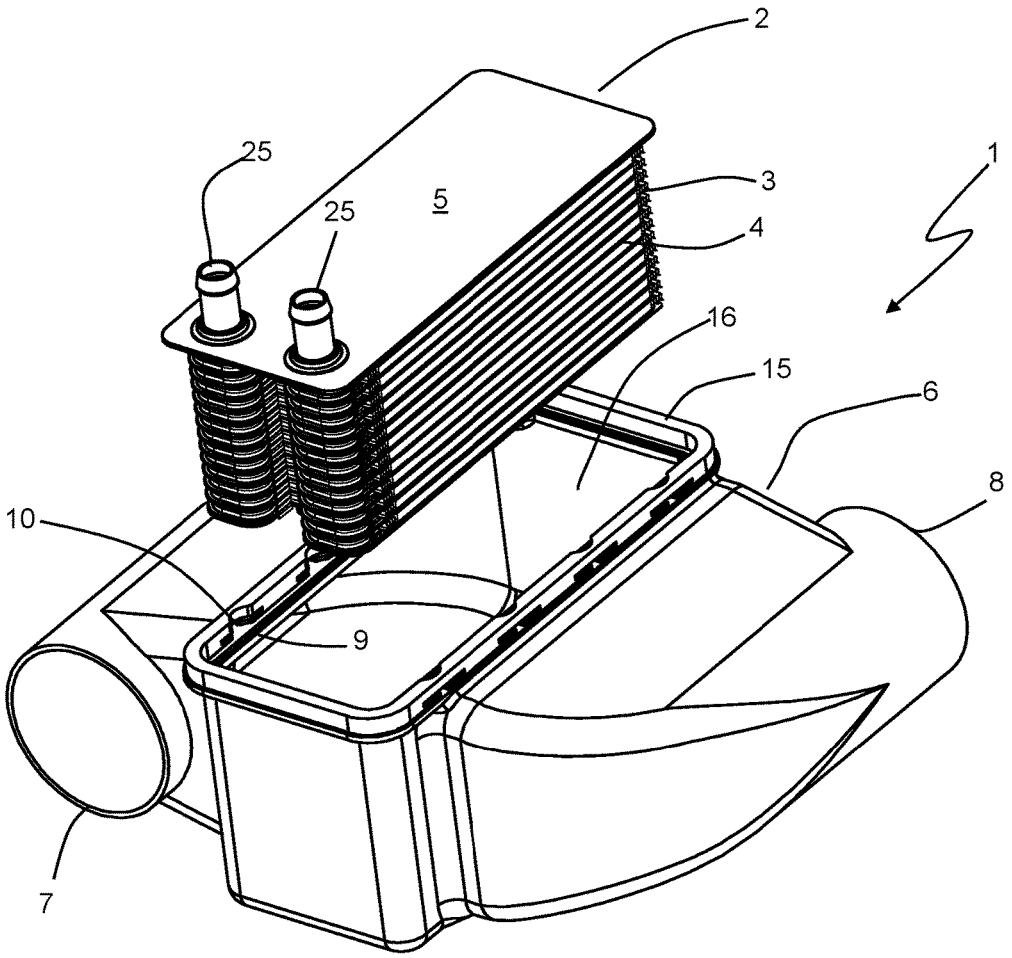
FIG. 3 is a partially exploded perspective view of portions of the heat exchanger of FIG. 1.

Referring still to FIG. 1, and with additional reference to FIGS. 3 and 5A-B, the heat exchanger 1 includes a heat exchange core 2 that is inserted into, and retained within, a cavity 16 of a heat exchanger housing 6. The housing 6 is preferably a molded or cast part, or an assembly of such parts, although other construction methods might be used as well. In some preferable embodiments the housing 6 can be formed of a plastic material, although aluminum or other metallic alloys can be used as well. The housing 6 includes an air inlet 7 and an air outlet 8, with an air flow passage established though the housing 6 between the inlet 7 and outlet 8. The cavity 6 is provided along the flow path, and is generally of a shape and size that closely conforms to the heat exchange core 2 so that substantially all of the charge air received into the heat exchanger 1 through the inlet port 7 is directed through the core 2 to be cooled.

The heat exchanger core 2 includes a top plate 5 and an alternatingly stacked arrangement of coolant plates 3 and air fins 4, typically made of aluminum and brazed together so that the core 2 is of a unitary construction. The coolant plates are of a two-piece construction, with a coolant flow passage provided within interior spaces of each coolant plate. Ends of the coolant flow passages are fluidly joined to coolant ports 25 that extend out of the heat exchanger 1 and can be used to couple the heat exchanger 1 into a coolant circuit (not shown). The air fins 4 can be of any of the multiple styles of fins known in the art, including but not limited to serpentine fins, lanced-offset fins, square wave fins, etc.

During typical operation of the heat exchanger 1 as a charge air cooler, a flow of compressed air is received into the heat exchanger 1 through the air inlet port 7. Liquid coolant is directed into the core 2 through one of the coolant ports 25, and is distributed to the coolant flow passages provided within the interior spaces of the coolant plates. The coolant is circuited through the coolant flow passages, and is collected and removed from the core 2 through the other of the coolant ports 25. The charge air flows through the spaces between the coolant plates 3, in channels defined by the air fins 4. Heat is transferred from the charge air to the coolant passing through the coolant flow passages, the coolant being at a lower temperature than the charge air, so that the charge air exits the core 2 at a substantially lower temperature than when it entered the air inlet 7. Having been cooled down to an acceptable temperature, the charge air exits the heat exchanger 1 through the air outlet port 8.

As best seen in FIGS. 1, 2, 3 and 5A-B, the housing 6 includes an aperture 9 disposed above the cavity 16, through which the core 2 can be inserted into the housing 6. The aperture 9 is preferably slightly larger than the outer periphery of the stack of coolant plates 3 and air fins 4, and is smaller than the outer periphery of the top plate 5. The aperture 9 is bounded by a generally planar bearing surface 10 of the housing, and a bottom face of the top plate 5 is disposed against, or adjacent to, the bearing surface 10 to close off the aperture 9. A gasket 23 is compressed between the bottom face of the top plate 5 and the housing 6 to create an air seal, so that compressed air is prevented from leaking out through the aperture 9 during operation of the heat exchanger 1. In the exemplary embodiment the gasket 23 is retained within a groove 24 that is formed into the bearing surface 10 along the periphery of the aperture 9. Alternatively, a flat gasket can be used to provide a face seal between a bottom face of the top plate 5 and the bearing surface 10.

Once the core 2 has been inserted into the housing 6, one or more retaining members are used to both retain the core within the housing and maintain the requisite compression of the gasket. In the heat exchanger 1 shown in FIG. 1, three retaining members 13 are provided for that purpose. The exemplary retaining members 13 are thin metallic parts that operate on a leaf spring principle. In their free state (shown in FIG. 4), the retaining members 13 define an arcuate profile, with a concave side and a convex side. The retaining members 13 can be elastically deformed from their arcuate free shape to a planar shape by the application of appropriate force. Elastically deformed, in this context, means that the stresses induced within the retaining member 13 as a result of such a deformation are below the yield strength of the material, such that the retaining member 13 would revert back to its arcuate free state upon the removal of the deforming force.

The installation of the retaining members 13 into the heat exchanger 1 can best be understood with reference to FIGS. 5A and 5B. A downward force is applied to a top surface of the top plate 5 in order to compress the gasket 23. A retaining member 13 is positioned in alignment with a pair of opposing recesses 14 provided in a wall 15 of the housing 6, the wall 15 at least partially surrounding the generally planar bearing surface 10, as shown in FIG. 5A. A force (indicated by the arrow in FIG. 5A) is applied to the convex surface of the retaining member 13 in order to flatten the retaining member 13, thereby directing ends of the retaining member 13 into the recesses 14. A locking tang 17 is provided near each of the opposing ends of the retaining member 13, and is formed outwardly to extend towards the concave side of the retaining member 13. As the retaining member 13 is flattened, the free ends of the tangs 17 contact the top surface of the top plate 5 and translate along that surface as the retaining member 13 continues to be deformed. FIG. 5B shows one such retaining member 13 in its installed, flattened state. In that state, the locking tangs 17 have translated to a position immediately beyond the outer edges of the top plate 5, and are disposed directly adjacent to those edges. Both the compressive force applied to the top plate 5 to compress the gasket, and the force applied to elastically deform the retaining member 13, can be removed, leaving the elastically deformed retaining member(s) 13 engaging the recesses 14 to maintain the gasket compression force.

The installed retaining members 13 are prevented from returning to their arcuate pre-installation shape by the presence of the locking tangs 17. As an installed retaining member 13 attempts to spring back to its arcuate shape, the edges of the locking tangs 17 contact the edges of the top plate 5, their movement being thereby halted. Movement of the retaining member 13 in a direction normal to and away from the top plate 5 is restricted by edges of the recesses 14, such that the retaining member 13 is captured. The installed retaining members 13 thus maintain the position of the top plate 5 relative to the bearing surface 10, and thereby also maintain the compression force on the gasket 23 in order to preserve the air-tight seal around the aperture 9.

Each of the recesses 14 includes a slot 22 along a portion of its length, with the slots 22 extending to the bearing surface 10. The slots 22 are each aligned with a locking tang 17 of an installed retaining member 13. Disassembly of the retaining members 13 from the heat exchanger 1 is accomplished by inserting a tool inwardly through the slots 22 corresponding to that retaining member 13, thereby deforming the corresponding locking tangs 17 so that the tangs 17 can pass over the edges of the top plate 5. In so doing, the retaining member 13 becomes free to return to its un-deformed, arcuate shape, and is freed from the heat exchanger 1.

Figure 6:
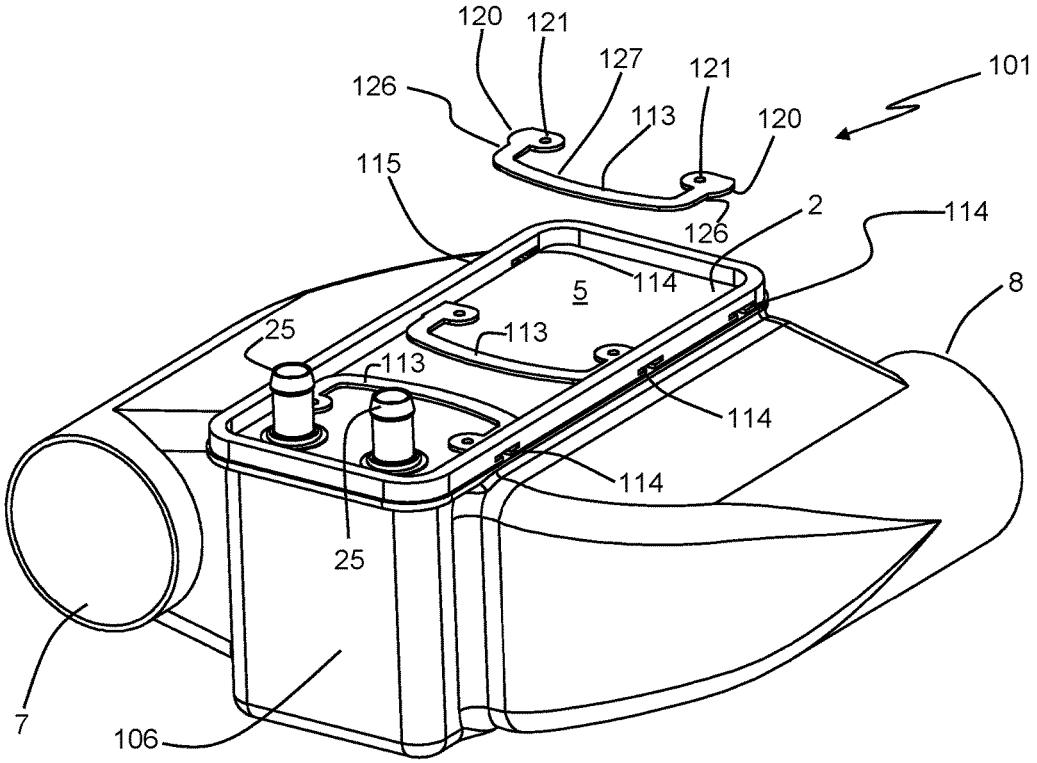
FIG. 6 is a partial exploded perspective view of a heat exchanger according to another embodiment of the invention.

An alternative embodiment of a heat exchanger 101 is depicted in FIG. 6, and uses the same heat exchanger core 2 in a slightly modified housing 106. Retention of the core 102 in the housing 106, and compression of the gasket seal, is maintained in a similar fashion to that described above with respect to the heat exchanger 1. Again, a force is applied to a top surface of the top plate 105 in order to compress a gasket and retaining members 113 are used to maintain the compression upon removal of the force. Two such retaining members 113 are shown in an installed state, while a third is shown un-installed from the heat exchanger 1.

The retaining members 113 are preferably stamped metal parts of a planar C-shape design, with arms 126 extending from opposing ends of an arcuate center portion 127. Locking extensions 120 are provided on outermost edges of the arms 126, and are sized to allow for insertion into recesses 114 provided at select locations along a wall 115 of the housing 106, similar to the recesses 14 and wall 15 of the heat exchanger 1. Assembly of a retaining member 113 into the heat exchanger 101 is accomplished by elastically deforming the retaining member 113 within its own plane so that the arms 126 move inwardly, thereby causing bending to occur within the arcuate center portion 127. Such deformation of the retaining member 113 can be facilitated through the use of an insertion tool (not shown) that engages holes 121 provided at each of the arms 126 and applies the required force. During installation the retaining member 113 is deformed sufficiently to allow the retaining member 113 to pass within the peripheral wall 115 to the top plate 105. Upon removal of the force used to elastically deform the retaining member 113, the locking extensions 120 seat within the recesses 114 and prevent removal of the retaining member 113. Removal of the retaining members 113, if desired, can be accomplished by reversing the installation process.

Yet another alternative embodiment of a heat exchanger 201 is depicted in FIGS. 7-9, also using the same heat exchanger core 2, in an again slightly modified housing 202. The housing 202 includes a peripheral wall 215 surrounding the aperture into which the heat exchange core 2 is received, but the peripheral wall 215 extends along only the two long sides of the core 2 and the short side of the core 2 adjacent to the coolant ports 25. Track-like recesses 229 are provided along those lengths of the wall 215 adjacent the long sides of the core 2, and are sized to receive a frame portion 228 of a retaining member 213.

The retaining member 213 is preferably a stamped metal part having an outer frame 228 formed in a U-shape, with a length and width that are similar to, but slightly larger than, the top plate 5 of the core 2. The retaining member 213 is assembled to the heat exchanger 201 by sliding, from the open end of the wall 215, along the top surface of the top plate 5 while a force is applied to that top surface in order to compress a gasket, as previously described with respect to the embodiments of FIGS. 1 and 6. The long portions of the outer frame 228 are received within the recesses 229, so that compression of the gasket is maintained after removal of the compression force used during assembly.

Arms 218 extend from end portions of the outer frame 228 to surround the coolant ports 25, with locking hooks 219 provided at the ends of the arms 228. The locking hooks 219 are received into a recess 214 provided along a portion of the wall 215 adjacent the ports 25, as best seen in FIG. 9. The recess 214 is sized so that, upon assembly of the retaining member 213 into the heat exchanger 1, an angled profile of each locking hook 219 contacts an edge of the recess 214, thereby causing the outer frame 228 to elastically deform within the plane of the retaining member 213 and allowing the hooks 219 to enter into the recess 214. Once the locking hooks 219 extend fully though the wall 215, the frame 228 is allowed to spring back to its un-deformed shape, and the hooks 219 engage against the exterior of the wall 215 to prevent removal of the retaining member 213. When desired, however, the retaining member 213 can be readily removed by squeezing together the locking hooks 219, thereby allowing them to be withdrawn back through the recess 214.

Figure 10A:
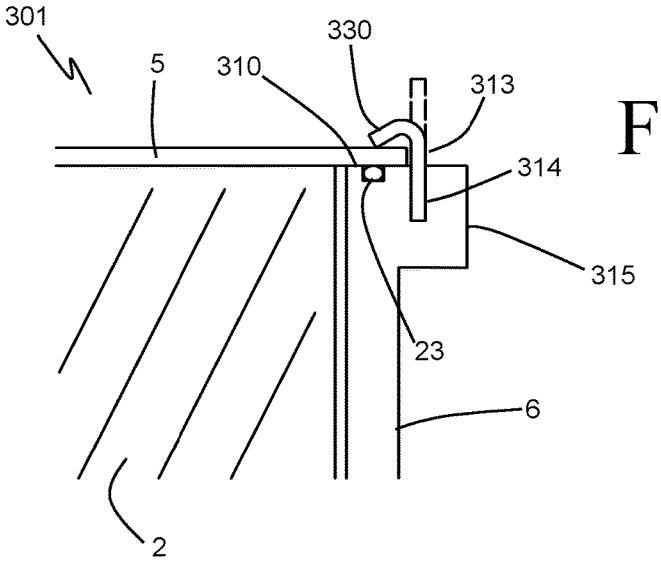
FIGS. 10A-B are partial sectional views of a heat exchanger according to two additional embodiments of the invention.
Figure 10B:
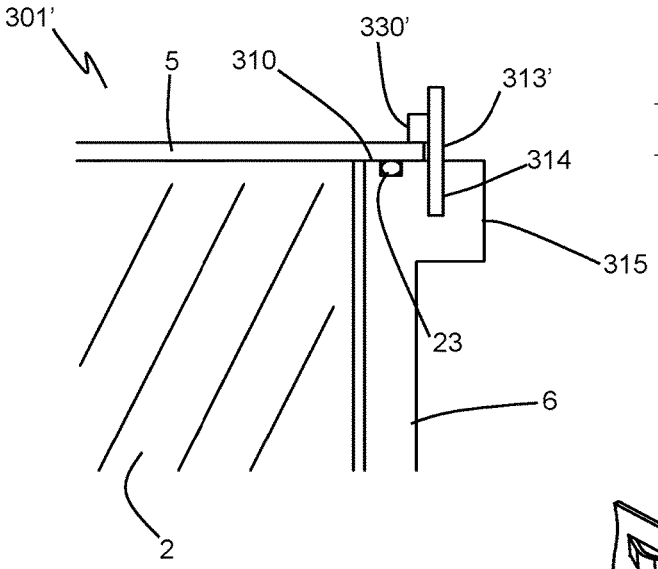
Figure 11:
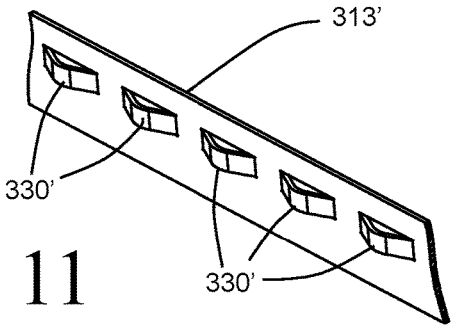
FIG. 11 is a partial perspective view of retaining clip of the heat exchanger of FIG. 10B.

FIGS. 10A and 10B show two additional embodiments of a heat exchanger. The heat exchanger 301 of FIG. 10A and the heat exchanger 301' of FIG. 10B are similar to the previously described embodiments in that a retaining member is deformed to secure the heat exchanger core 2 within the housing 6 in a leak-free manner. The heat exchanger core 2 is not shown in detail, but is essentially unchanged from the previously described embodiments, and again includes a top plate 5 arranged at an uppermost end of the core 2. The top plate 5 again is disposed against a bearing surface 310 of the housing 6, and a leak-free seal is thereby created through the compression of the gasket 23.

The peripheral wall 315 extends around the aperture of the housing 6 into which the core 2 is received, but in these particular embodiments that wall 315 extends outward from the core instead of extending upward. A retaining clip 313, 313' is partially received into a recess 314 that is provided along the wall 315. The retaining clip can be secured into the recess 314 in a variety of ways, including insert molding, heat staking, ultrasonic welding, and friction fitting, among others. In order to secure the top plate 5 against the bearing surface 310 and create the leak-free seal, a portion 330, 330' of the retaining clip 313, 313' is plastically deformed in order to provide a permanent downward acting force upon the top plate 5, thereby preventing movement of the heat exchanger core 2 in a direction opposite to the insertion direction.

The two embodiments 301, 301' differ slightly in the design of the retaining clip. The retaining clip 313 of the heat exchanger 301 is crimped over to that a top edge of the retaining clip 313 bears directly on the top plate 5. The deformed portion 330 is depicted in FIG. 10A its un-deformed state using dashed lines. The heat exchanger 301', depicted in FIG. 10B, uses a retaining clip 313' which has pre-pierced deformable features 330' arranged along the periphery of the housing 6. After insertion of the core 2 into the aperture of the housing 6, the features 330' are deformed inwardly to partially overlay the top plate 5, as illustrated in FIG. 10B.

As was the case in the previously described embodiments, the heat exchanger core 2 can be removed from the housing 6 by restoring the deformed portion 330, 330' to its undeformed state, thereby allowing for service or replacement of the core 2.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A heat exchanger for cooling a flow of charge air, comprising:

a heat exchanger core having alternating coolant plates and air fins arranged in a core stacking direction and a top plate at one end of the heat exchanger core in the core stacking direction;

a housing comprising an air inlet, an air outlet, an aperture through which the coolant plates and air fins are received into the housing, a bearing surface, and a peripheral wall located peripheral to the bearing surface, the peripheral wall including a first slot on a first side of the housing and a second slot on a second side of the housing, the second side being opposite of the first side of the housing;

a gasket compressed between a first face of the top plate and the housing to provide an air seal at the aperture; and a retaining member disposed against a second face of the top plate, the retaining member comprising a first end portion and a second end portion opposite the first end portion;

wherein the top plate is disposed on top of the bearing surface;

wherein the top plate is at least partially located within the housing and extends from the first side of the housing to the second side of the housing;

wherein the first end portion engages the first slot and the second end portion engages the second slot; and wherein the retaining member is elastically deformed to secure the retaining member to the housing.

2. The heat exchanger of claim 1, wherein the retaining member is in one of a C-shape and a U-shape, and wherein a middle portion of the retaining member contacts a second side of the top plate.

3. The heat exchanger of claim 2, wherein the middle portion is elastically deformable.

4. The heat exchanger of claim 2, wherein the middle portion is deformable along a plane parallel to the second face of the top plate.

5. The heat exchanger of claim 1, wherein the retaining member includes one or more outwardly-formed tangs to secure the retaining member to the housing and wherein the one or more tangs are located at the first end portion or the second end portion, or at both the first end portion and the second end portion.

6. The heat exchanger of claim 5, wherein the top plate includes a first side edge and an opposite second side edge, each of the first side edge and the second edge extending between the first face and the second face of the top plate, and wherein the one or more outwardly-formed tangs engage either the first side edge or the second side edge.

7. The heat exchanger of claim 5, wherein the retaining member is elastically deformed from an arcuate shape to a planar shape during an installation process.

8. The heat exchanger of claim 1, wherein the first end portion extends beyond a first side edge of the top plate, wherein the second end portion extends beyond a second side edge of the top plate, wherein the first side edge is on the same side of the housing as the air inlet and the second side edge is on the same side of the housing as the air outlet, and wherein a middle portion of the retaining member engages the second face of the top plate.

9. The heat exchanger of claim 8, wherein the second face of the top plate is planar.

10. The heat exchanger of claim 1, further comprising, a second retaining member having a first end portion and a second end portion;

a third slot disposed on the first side of the housing; and a fourth slot disposed on the second side of the housing, wherein the first end portion of the second retaining member engages the third slot, and wherein the second end portion of the second retaining member engages the fourth slot.

11. The heat exchanger of claim 1, wherein the housing includes a third slot and a fourth slot, wherein the third slot and the fourth slot are located on a third side of the housing and adjacent to each other, and wherein the retaining member engages each of the third slot and the fourth slot.

12. The heat exchanger of claim 1, wherein the bearing surface of the housing includes an inner edge, and wherein the inner edge defines the aperture.

13. The heat exchanger of claim 1, wherein a middle portion of the retaining member is elastically deformed from an arcuate shape to a planar shape to retain the top plate within the housing.

14. The heat exchanger of claim 1, wherein the first slot and the second slot each extend from a third side of the housing to a fourth side of the housing, and wherein the first end portion and the second end portion each extend from the third side to the fourth side.

15. The heat exchanger of claim 14, wherein the retaining member extends through one of the third side and the fourth side.

* * * * *